US006811127B1

(12) United States Patent
Shiao

(10) Patent No.: US 6,811,127 B1
(45) Date of Patent: Nov. 2, 2004

(54) MAGNETIC RETAINER FOR RETAINING ARTICLES THEREON

(76) Inventor: Hsuan-Sen Shiao, 55, Cheng-feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 10/669,937

(22) Filed: Sep. 24, 2003

(51) Int. Cl.[7] ..... A47G 1/17

(52) U.S. Cl. ..... 248/206.5; 211/70.6; 211/DIG. 1; 248/309.4

(58) Field of Search ..... 248/206.5, 309.4, 248/683; 211/88.01, 190, 70.6, DIG. 1

(56) References Cited

U.S. PATENT DOCUMENTS 5,350,065 A * 9/1994 Darrey ..... 206/373
2003/0038100 A1 * 2/2003 Liu ..... 211/88.01
2003/0222036 A1 * 12/2003 Lacombe et al. ..... 211/70.6
2004/0055979 A1 * 3/2004 Fabregas ..... 211/70.6

* cited by examiner

*Primary Examiner*—Ramon O Ramirez
(74) *Attorney, Agent, or Firm*—Trop, Pruner & Hu, P.C.

(57) ABSTRACT

A magnetic retainer includes a molded one-piece plastic mounting member having a bowl-shaped part and an elongated part. The bowl-shaped part includes a base formed with a plurality retaining holes, and a peripheral wall extending upwardly from the base. The elongated part projects from the peripheral wall and is formed with an elongated groove. A magnet is fixed in each of the retaining holes in the base. A magnet-holding frame is fitted snugly in the elongated groove in the elongated part and defines a holding groove. An elongated magnetic unit is mounted securely in the holding groove in the magnet-holding frame.

4 Claims, 4 Drawing Sheets

MAGNETIC RETAINER FOR RETAINING ARTICLES THEREON

BACKGROUND OF THE INVENTION

1. Field of the Invention

The present invention relates to a retainer, more particularly to a magnetic retainer for retaining articles thereon by magnetic attraction.

2. Description of the Related Art

A conventional magnetic retainer, as shown in FIG. 1, generally includes a holding member 1 and an elongated magnetic bar 2. The holding member 1 includes a base plate 101 which is adapted to be mounted on a wall, and a magnet-holding part 102 disposed on and cooperating with the base plate 101 to define a magnet-retention groove 103 therebetween. The magnetic bar 2 is mounted in the magnet-retention groove 103.

The conventional magnetic retainer is suitable specially for retaining long tools, such as spanner, screw drivers, files, etc., thereon, but retention of a variety of articles, like screws, bolts, nuts, etc., is not appropriate due to the elongated configuration of the holding member 1.

SUMMARY OF THE INVENTION

Therefore, the object of this invention is to provide a magnetic retainer which is capable of retaining a plurality of articles regardless of their sizes and lengths so as to overcome the aforesaid disadvantage of the prior art.

According to the present invention, the magnetic retainer includes: a molded one-piece plastic mounting member including a bowl-shaped part and an elongated part integrally formed with the bowl-shaped part, the bowl-shaped part including a base that has top and bottom faces, and a peripheral wall extending upwardly from the top face of the base to define a receiving space therebetween, and having a top end face distal from the base, the base being formed with a plurality retaining holes, each of which is defined by a hole-confining wall, the elongated part projecting outwardly and laterally from the peripheral wall, and having a top face and formed with an elongated groove which is defined by a groove-confining wall, the groove-confining wall having two opposite ends and being formed with two opposite shoulders that project respectively from the opposite ends of the groove-confining wall into the groove; a plurality of magnets, each of which is fixed in a respective one of the retaining holes in the base; a metal sheet disposed within the receiving space and attached to the top face of the base through magnetic attraction of the magnets; a covering disc attached securely to the bottom face of the base to cover the retaining holes so as to prevent removal of the magnets from the retaining holes; a magnet-holding frame fitted in the elongated groove, seated on the shoulders, defining a holding groove, and having two opposite ends; and an elongated magnetic unit mounted securely in the holding groove in the magnet-holding frame.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 1:
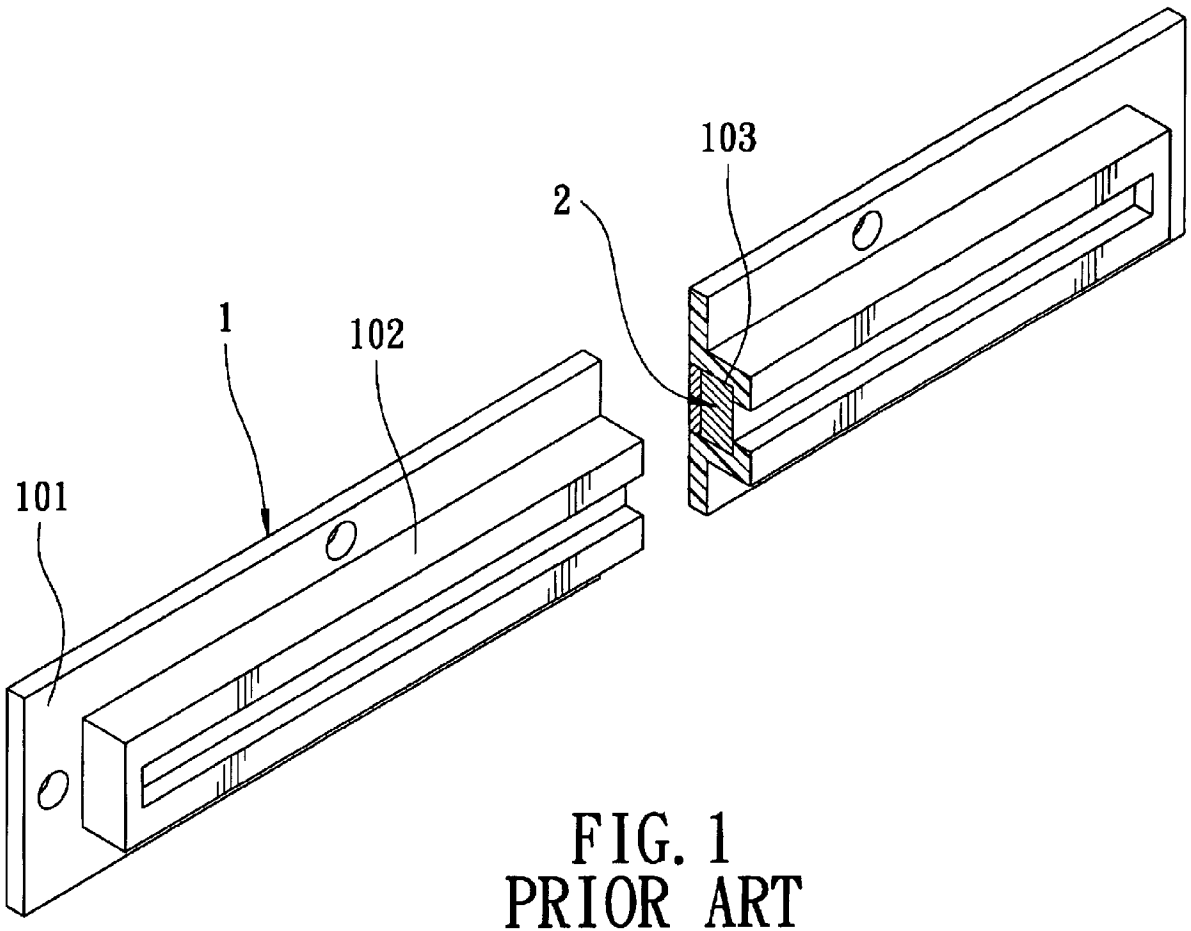
FIG. 1 PRIOR ART
FIG. 1 is a partly sectional perspective view of a conventional magnetic retainer for retaining articles thereon.
Figure 2:
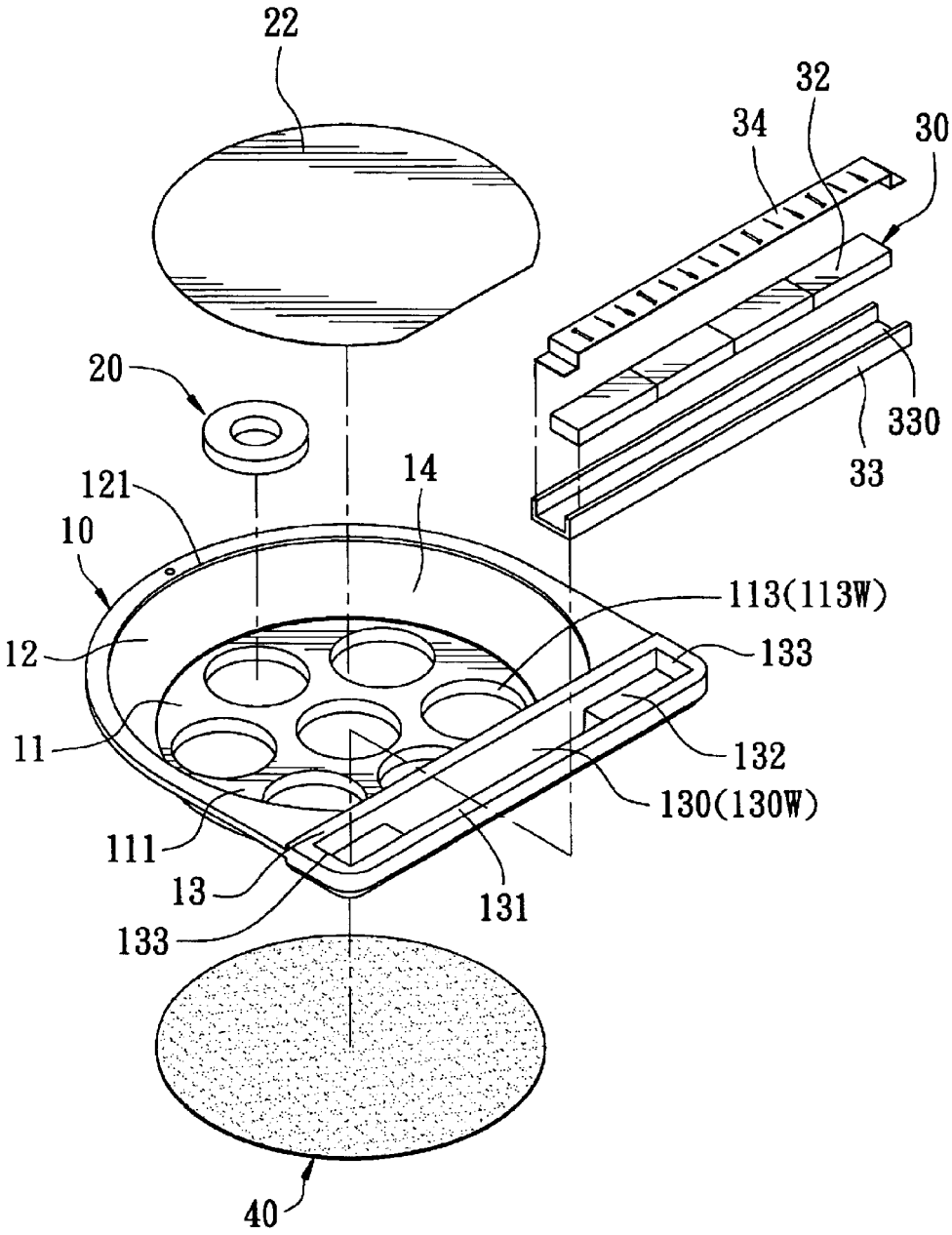
FIG. 2 is an exploded perspective view of the preferred embodiment of a magnetic retainer according to the present invention for retaining articles thereon.
Figure 3:
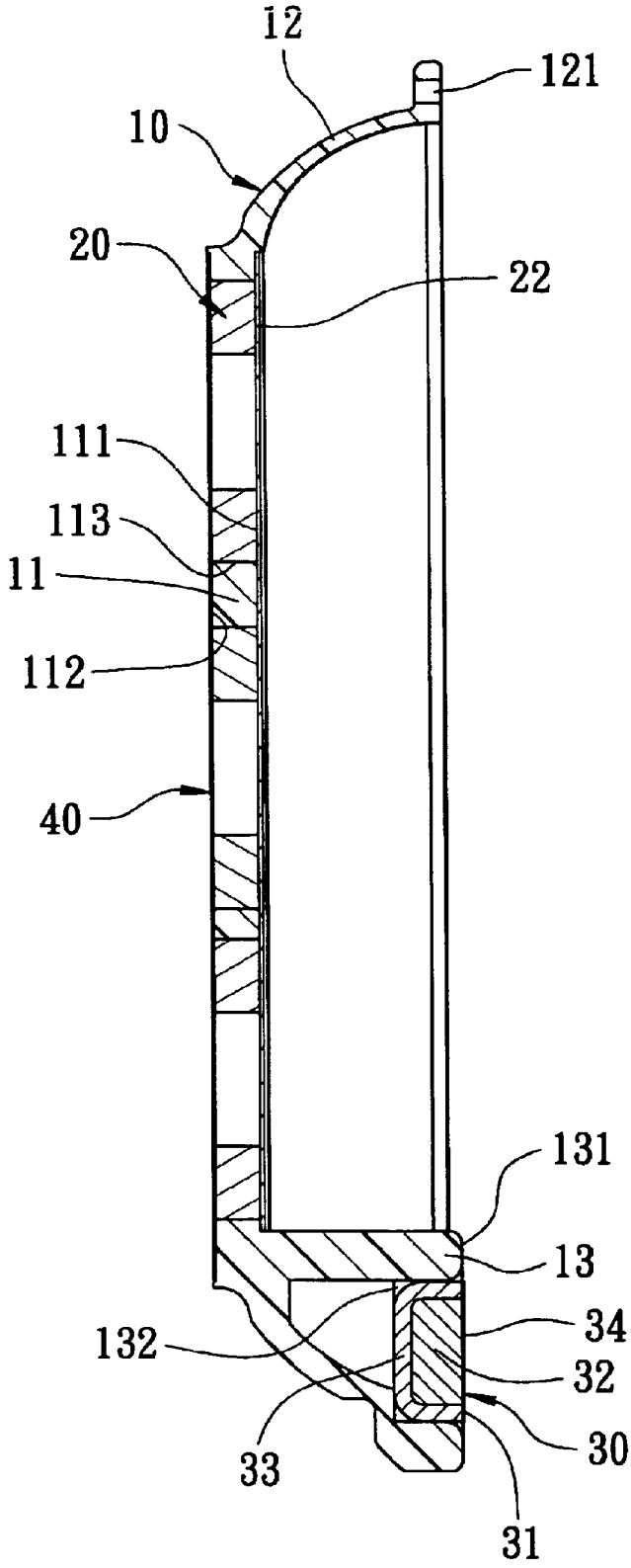
FIG. 3 is a schematic sectional view of the preferred embodiment.

Referring to FIGS. 2 and 3, the preferred embodiment of a magnetic retainer according to the present invention is shown to include a molded one-piece plastic mounting member 10, a plurality of annular magnets 20 (only one is shown in FIG. 2), a metal sheet 22, a covering disc 40, a U-shaped magnet-holding frame 33, an elongated magnetic unit 30, and an adhesive tape 34.

As illustrated, the mounting member 10 includes a bowl-shaped part 12 and an elongated part 13 integrally formed with the bowl-shaped part 12. The bowl-shaped part 12 includes a base 11 that has top and bottom faces 111,112, and a peripheral wall 14 that extends upwardly from the top face 111 of the base 11 to define a receiving space therebetween, and that has a top end face 121 in the form of a flange. The base 11 is formed with a plurality retaining holes 113, each of which is defined by a hole-confining wall (113W) The elongated part 13 projects outwardly and laterally from the peripheral wall 14, and has a top face 131 that is disposed at an elevation higher than the top end face 121 of the peripheral wall 14. The top face 131 of the elongated part 13 is formed with an elongated groove 130 which is defined by a groove-confining wall (130W). The groove-confining wall (130W) has two opposite ends 133, and is formed with two opposite shoulders 132 that project respectively from the opposite ends 133 of the groove-confining wall (130W) into the groove 130.

Each of the annular magnets 20 is press-fitted in a respective one of the retaining holes 113 in the base 11 and engages frictionally the hole-confining wall (113W) that defines the respective one of the retaining holes 113.

The metal sheet 22 is disposed within the receiving space of the mounting member 10, and is attached to the top face 111 of the base 11 through magnetic attraction of the annular magnets 20.

The covering disc 40 is attached securely to the bottom face 112 of the base 11 to cover the retaining holes 113 so as to prevent removal of the annular magnets 20 from the retaining holes 113 in the base 11.

The magnet-holding frame 33 is fitted snugly in the elongated groove 130, is seated on the shoulders 132 of the groove-confining wall (130W), defines a holding groove 330, and has two opposite ends.

The elongated magnetic unit 30 is mounted securely in the holding groove 330 in the magnet-holding frame 33, and has a top face flush with the top face 131 of the elongated part 13. In the preferred embodiment, the elongated magnetic unit 30 is formed by four separate magnetic bar pieces 32.

The adhesive tape 34 is attached adhesively to the top face of the magnetic unit 30, and to the opposite ends of the magnet-holding frame 33.

Figure 4:
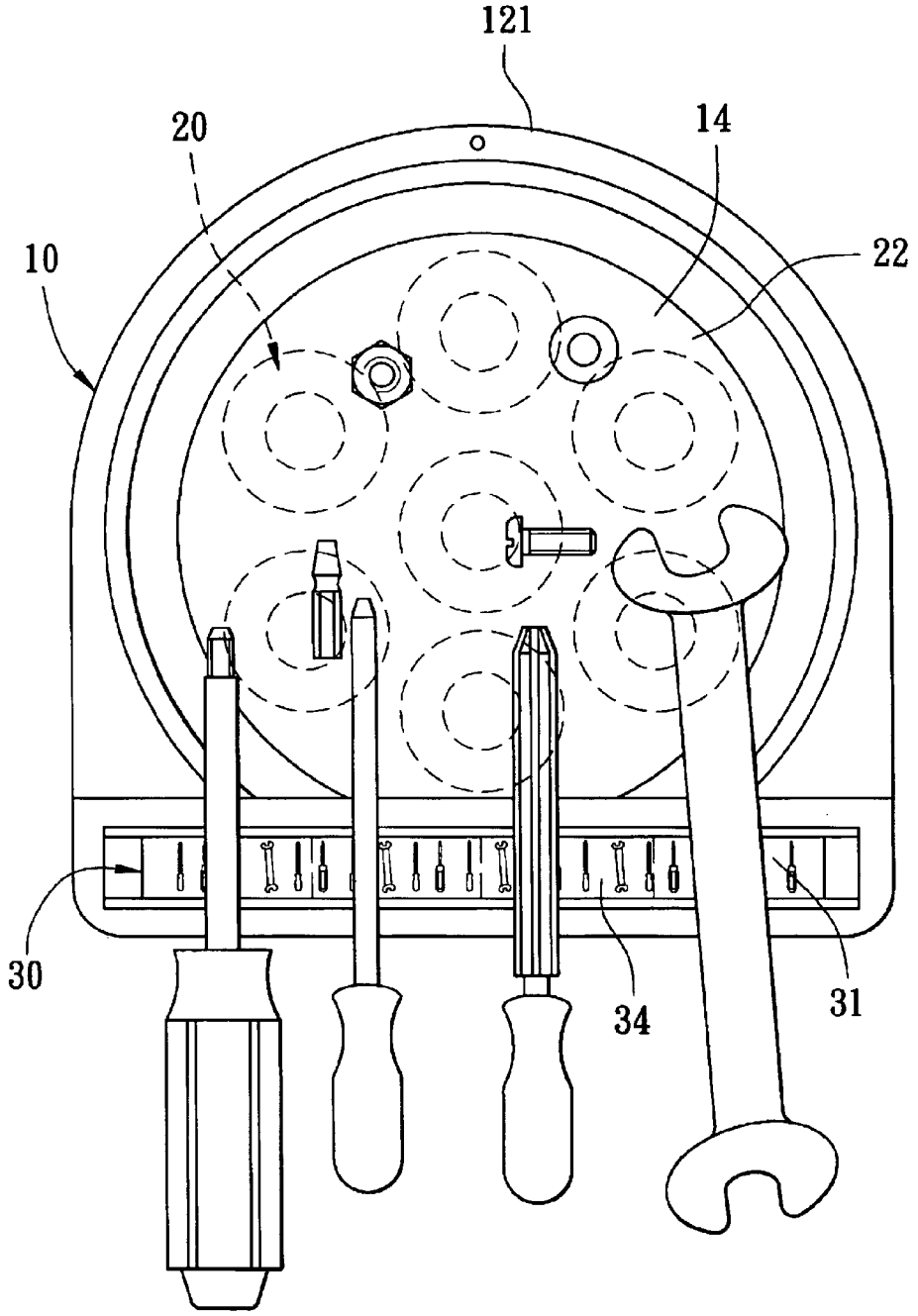
FIG. 4 is a front view to illustrate the preferred embodiment in a state of use.

Referring to FIG. 4, during use, the bowl-shaped part 12 can be mounted on a magnetically attractive wall, such as a car body, or on a concrete wall through a mounting hole formed in the top end face 121 of the peripheral wall 14. Small articles, such as screws, driving bits, washers and nuts, can be retained in the receiving space of the bowl-shaped part 12 by virtue of magnetic attraction, while long tools, such as screwdrivers, spanners, files, etc., can be retained on the elongated part 13 by virtue of the magnetic unit 30.

Since the magnetic retainer of the present invention can retain magnetically a variety of articles regardless of their lengths and sizes, the aforesaid disadvantage of the prior art can be overcome, accordingly.

With this invention thus explained, it is apparent that numerous modifications and variations can be made without departing from the scope and spirit of this invention. It is therefore intended that the invention be limited only as indicated in the appended claims.

I claim:

1. A magnetic retainer comprising:

a molded one-piece plastic mounting member including a bowl-shaped part and an elongated part integrally formed with said bowl-shaped part, said bowl-shaped part including a base that has top and bottom faces, and a peripheral wall extending upwardly from said top face of said base to define a receiving space therebetween, and having a top end face distal from said base, said base being formed with a plurality retaining holes, each of which is defined by a hole-confining wall, said elongated part projecting outwardly and laterally from said peripheral wall, and having a top face and formed with an elongated groove which is defined by a groove-confining wall, said groove-confining wall having two opposite ends and being formed with two opposite shoulders that project respectively from said opposite ends of said groove-confining wall into said groove;

a plurality of magnets, each of which is fixed in a respective one of said retaining holes in said base;

a metal sheet disposed within said receiving space and attached to said top face of said base through magnetic attraction of said magnets;

a covering disc attached securely to said bottom face of said base to cover said retaining holes so as to prevent removal of said magnets from said retaining holes;

a magnet-holding frame fixed in said elongated groove, seated on said shoulders, defining a holding groove, and having two opposite ends; and an elongated magnetic unit mounted securely in said holding groove in said magnet-holding frame.

2. The magnetic retainer as defined in claim 1, wherein said top face of said elongated part is disposed at an elevation higher than that of said top end face of said peripheral wall.

3. The magnetic retainer as defined in claim 1, wherein said elongated magnetic unit has a top face flush with said top face of said elongated part.

4. The magnetic retainer as defined in claim 1, further comprising an adhesive tape attached adhesively to said top face of said magnetic unit, and to said opposite ends of said magnet-holding frame.

* * * * *